United States Patent [19]

Caccitolo

[11] Patent Number: 5,051,725

[45] Date of Patent: Sep. 24, 1991

[54] SECURITY CONTAINER

[75] Inventor: Michael F. Caccitolo, Chicago, Ill.

[73] Assignee: SOA Systems, Inc., Chicago, Ill.

[21] Appl. No.: 539,920

[22] Filed: Jun. 18, 1990

[51] Int. Cl.[5] ..... G08B 13/14

[52] U.S. Cl. ..... 340/571; 220/334; 340/689; 340/693

[58] Field of Search ..... 340/571, 693, 689, 566; 220/210, 334

[56] References Cited

U.S. PATENT DOCUMENTS

| | | | |
|---|---|---|---|
| 4,117,468 | 9/1978 | Vasquez | 340/571 |
| 4,155,079 | 5/1979 | Chiu et al. | 340/571 |
| 4,204,202 | 5/1980 | Pai | 340/571 |
| 4,462,023 | 7/1984 | Nielsen | 340/571 |
| 4,470,040 | 9/1984 | Kaminishi | 340/566 |
| 4,620,644 | 11/1986 | Miller | 220/334 |
| 4,841,285 | 6/1989 | Laut | 340/571 |
| 4,876,532 | 10/1989 | Sauls | 340/571 |

FOREIGN PATENT DOCUMENTS

| | | |
|---|---|---|
| 2077971 | 12/1981 | United Kingdom . |
| 2131213 | 6/1984 | United Kingdom . |

OTHER PUBLICATIONS

Instructions for Burglar Alarm, Catalog No. 49-419, by Safe-House.

Specification for Container by Lewis Systems, Model Nos. F40 and F50.

Specification Sheets for Buckhorn Containers.

Advertisement for Jumbo Cart Pak Container.

*Primary Examiner*—Glen R. Swann, III

*Attorney, Agent, or Firm*—Wallenstein, Wagner & Hattis, Ltd.

[57] ABSTRACT

An improved security storage assembly (9) that is lockable, that can store many different items, and that can warn the owner or user thereof if someone is attempting to break into it is disclosed. The assembly (9) includes a container (10) having walls (11,12), a closed bottom (16) and a cover (19) hingedly connected to the top (T) of a wall. A lock assembly (40) is disposed in the cover (19) for interconnecting the cover (19) to a wall (11). A motion-detecting alarm member (50) having a sensing mechanism for detecting a greater than threshold amount of motion and having a coupled alarm element therein for emitting an alarm signal when said greater than threshold amount of motion has been detected is removably mounted within the container (10). A fastening element (61) is fixedly secured to the motion-detecting alarm member (50) and a plurality of cooperating fastening receiving elements (60) are spaced apart on and fixedly secured to the upper portion of the interior of the walls (11,12). A plurality of apertures (13,14) being sized so as to permit the alarm to emanate from the container (10) and to prevent an entire adult hand from passing therethrough are also in the top portions of the walls (11,12).

16 Claims, 1 Drawing Sheet

SECURITY CONTAINER

DESCRIPTION

1. TECHNICAL FIELD

The present invention relates to containers for storing items in, and more particularly, to a security container that can be locked and that can emit an alarm if improperly handled, manipulated or broken into.

2. BACKGROUND PRIOR ART

During exhibition hall shows, it is common practice for individuals and companies to either rent or own containers for storing their items. Items, such as samples, prototypes, brochures and merchandise, are often times kept in these exhibition hall containers. Typically, the individuals keep the container in or very near to their exhibition booth so that they may have immediate access to the containers. Unfortunately, because the people working the booths are frequently busy promoting themselves, their company, or their goods and services, thieves too often open up the containers and steal the contents therein unnoticed.

This problem of theft and another problem of mishandling exist not only in exhibition halls, but also in other arenas, such as in warehouses and with personal briefcases. Previous attempts to alarm such cases and containers have been attempted. For example, GB 2,077,971, discloses a system wherein an object being stored in a package has an inclination responsive power-operated sound alarm fastened to it. A sound alarm gives warning if an excessive inclination of the object in the package has been reached. While potentially advantageous for monitoring special, incline-sensitive items, such a system cannot sufficiently guard against theft, since an individual can break into the package without disturbing the alarm and disconnect the alarm before removing the stored object.

Similarly, U.S. Pat. Nos. 4,204,202, 4,155,079, and 4,117,468 disclose personal briefcases or suitcases that have alarms built into their interiors. Having an alarm, such as those disclosed in these patents that are securely fixed within the case, not only poses an obstacle to anyone packing or unpacking the case, but also limits the arrangement of the items packed therein.

Moreover, the art is replete with various alarms. Such alarms include: GB 2,131,213, which discloses a self-contained alarm apparatus having an inertia sensor therein that is attachable to an article to be protected; U.S. Pat. No. 4,841,285, which discloses a tilt-responsive display case alarm that includes a mercury switch; and, U.S. Pat. No. 4,462,023, which discloses a self-contained, personal-property type, position sensitive alarm that can be attached to items. However, while potentially good alarms, these alarms are not instructive or sufficient alone in protecting the contents of a storage container.

There remains a significant need for a lockable container that can store many different items and that can warn the owner or user thereof if someone is attempting to break into it.

SUMMARY OF THE INVENTION

The improved security storage assembly of the present invention permits one to lock a container, detect a violation thereof and to pack it in any one of many ways. This improved assembly includes a container for storing items therein that has an interior and an exterior, side walls, end walls, and a bottom. Each end wall has a top portion with an interconnecting lid hingedly connected to it. The two lids form a cover for the container by interconnecting one another so that when one lid is locked, both lids will be locked. A lock assembly for coupling each lid to a container side wall is provided for preventing improper entry therein.

An audio motion-detecting alarm member is removably mounted within the container. This audio motion-detecting alarm member includes a sensing mechanism for detecting a greater than threshold amount of motion and a speaker element connected to the sensing mechanism for emitting an alarm siren when the greater than threshold amount of motion has been detected. Attached to the audio motion-detecting alarm member is a first fastening element. Cooperating with the first fastening element is a second fastening element fixedly secured to the interior of the container. Both such elements are for removably supporting the audio motion-detecting alarm member to the container's interior walls in one of a plurality of locations. Preferably, the first fastening element is a strip of material having a series of minute, rigid hook-like projections thereon and the second fastening element is a strip of tiny, soft loops or hirsute material. Also, preferably, the second fastening element is a plurality of strips of the hirsute material with each of the strips being positioned at a location on the interior wall in the upper portion of the wall, i.e., being closer to the wall top than to the container bottom.

The container of the present invention further includes apertures in the upper portions of the walls that have a relatively small cross-sectional area so as to prevent an entire adult hand from passing therethrough; but, the apertures are large enough to permit the alarm siren generated by the audio motion-detecting alarm member to emanate from the interior of the container. In the preferred embodiment, the apertures are sized so as to permit a portion of an individual's hand to pass therethrough so as to act as a gripping slot to aid in carrying and maneuvering the improved container.

Thus, an individual can safely pack and store items in the container, turn the audio motion-detecting alarm on and place it in one of many available locations within the container and lock up the entire assembly. Because a storage container is packed many different ways with many different, diverse items, the audio motion-detection alarm member can be positioned after the container is loaded. Being positioned in the upper portion of the container, the audio motion-detecting alarm is easy to find and access when the container is open and less likely to be damaged by contents sliding in the container. Should someone try to steal the container or to break into it, the audio motion-detecting alarm will be shaken more than a threshold amount and generate an audio alarm siren. This typically scares the intruder away. And, the alarm siren warns the individual in charge of the container that it has been violated so that appropriate action can be taken. The individual in charge can then unlock the container and turn the audio motion-detecting alarm member off.

Other advantages and aspects of the present invention will become apparent upon reading the following description of the drawings and detailed description of the invention.

DETAILED DESCRIPTION

Figure 1:
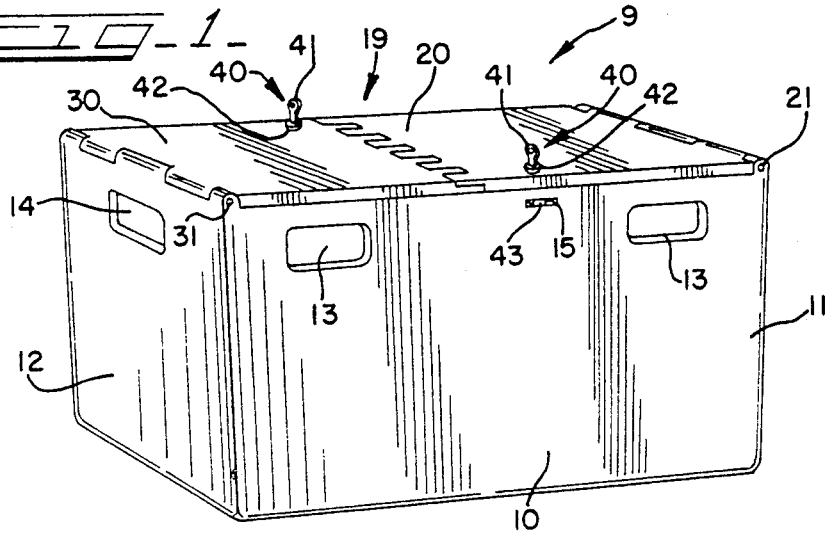
FIG. 1 is a perspective side view of a security container with its cover locked closed that is made in accordance with the teachings of the present invention.

While this invention is susceptible of embodiment in many different forms, there is shown in the drawings and will herein be described in detail a preferred embodiment of the invention. It should be understood, however, that the present disclosure is to be considered an exemplification of the principles of the invention. It is not intended to limit the broad aspect of the invention to embodiment illustrated.

FIG. 1 of the drawings shows an improved security storage assembly, generally designated by the reference numeral 9, that has been constructed in accordance with the teachings of the present invention. This security container assembly 9 includes a container 10 that is for storing items within the interior thereof. This container 10 is an integral open box that has opposed side walls 11, opposed end walls 12, and a bottom 16. While the container 10 is shown to be rectangular in shape, it is appreciated that it can easily be other shapes, such as circular and triangular. Each of the walls 11, 12 has an uppermost portion or top T. A cover 19 is hingedly connected to the top T of the end wall 12. A cover 19 that is a single lid hingedly connected to one wall 12 that transverses the entire top of the container 10 is sufficient; however, such lids tend to be extremely heavy, difficult to maneuver in cramped quarters, and more susceptible to breakage. In the preferred embodiment shown in the drawings, this cover 19 is composed of two interlocking lids 20, 30. Specifically, at one end, each lid 20, 30 is hingedly interconnected to the top of an end wall 12 by a hinge 21, 31, and at the other end, each lid 20, 30 interlocks with the other lid 30, 20.

Each hinge connection 21, 31 permits each lid 20, 30 to rotate, or be movable, between an open position (FIG. 3) and a closed position (FIG. 1).

There are many types of interlocking lids. Two important features of the lids of the present invention are that both lock and stay closed if one such lid is locked and that neither lid entirely traverses the top opening of the container. In the illustrated embodiment, each lid 20, 30 has an interlocking portion 25, 35 at the end opposed the hinged end. One interlocking portion 35 has a plurality of recessions R in its top surface 30A while the other interlocking portion 25 has a plurality of recessions R in its bottom surface 20B. With this construction, each lid will interfit with the other lid when they are closed. By this design, if the lids are properly closed, i.e., interlocked with their interlocking portions 25, 35 mating, both lids must be unlocked for either of them to be rotatable to the open position. If one lid is locked while the lids 20, 30 are interlocked, neither lid can be rotated to the open position.

A suitable container is disclosed in U.S. Pat. No. 4,620,644, entitled TOTE BOX WITH LID CONTAINER, which discloses a container having interlocking cover elements and a plurality of hand hold apertures for aiding the carrying of the container.

Figure 3:
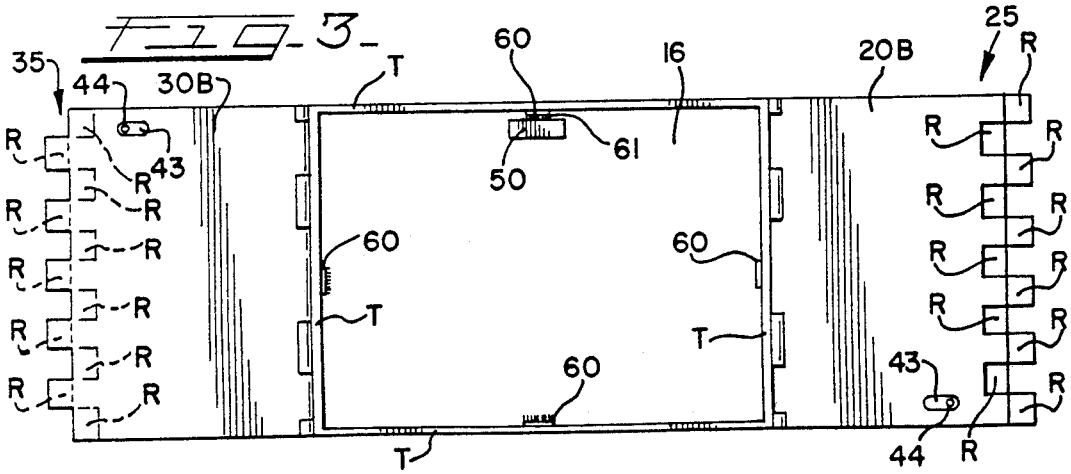
FIG. 3 is a top elevation view of a security container with its cover opened that is made in accordance with the teachings of the present invention; and, FIG. 4 is a partial perspective top view of the two interlocking lids made in accordance with the teachings of the present invention.

The improved security storage assembly 9 further includes a lock assembly 40 for coupling the cover 19 to the container 10 to keep the cover closed and for preventing improper entry into the container 10. Specifically, each lid 20, 30 has a lock assembly 40 connected thereto and disposed therein for engaging a side wall 11. The lock assembly 40 includes a key hole and tumbler assembly 42 and a rotating cam 43 so that when the proper key, designated by reference number 41, is inserted into and rotated within the key hole and tumbler assembly 42, the activated cam 43 rotates about a pivot 44 (FIG. 3). A cam slot 15 disposed within the side wall 11 cooperates with the lock's cam 43. For example, as shown specifically in FIG. 1, when a lid 20, 30 is locked to a side wall 11, the cam 43 of the lock assembly 40 is disposed within the cam slot 15 of the side wall 11. The lid 20, 30 will thus be prevented from moving or rotating about its hinge 21, 31 because the lock's cam 43 is secured within the confines of the cam slot 15. The cam slot 15 is wide enough to permit the cam 43 to rotate horizontally in and out of it, but the slot's height is minimal so as to prevent vertical movement of the cam 43 disposed therein.

This interaction between the cam 43 and cam slot 15 provides a convenient means for detecting and identifying that the container 10 is locked. As is evident in FIG. 1, an individual viewing the assembly 9 from the outside can visually see the cam 43 projecting through the cooperating slot 15 in the wall 11. Identifying marks, such as labels or signs, can be placed adjacent to the slot 15 on the exterior of the walls 11, 12 so as to warn individuals about the alarm and about the lock.

Preferably, each lock assembly 40 engages a separate side wall 11 and is disposed in the lid 20, 30 at a position closer to the lid's end having the interlocking portions 25, 35 than the lid's other end connected to the hinge 21, 31. In this manner, the locking of one lid 20, 30 will securely lock both lids, when they are both closed and interconnected to one another.

An audio motion-detecting alarm member 50, hereinafter "AMDA member," is removably attached to the interior of the container 10. The AMDA member 50 includes a motion-sensing mechanism that detects the motion of the AMDA member 50 which, in turn, detects the motion of the container 10. Specifically, the AMDA member 50 has a motion-detector therein that detects a greater than threshold amount of motion, and if a greater than threshold amount of motion is detected, the AMDA member 50 emits an alarm siren through a speaker element that is also in the AMDA member 50 and is coupled with the motion-detector. Such AMDA members are known in the alarm art. A suitable AMDA member 50 called a "Burglar Alarm," Catalog No. 49-419, by Safe House ® is presently manufactured for and sold by Radio Shack ®, a division of Tandy Corporation.

Preferably, the AMDA member includes, in addition to the motion-detector and coupled speaker element, an on/off switch and an adjuster element that controls the sensitivity of the device and the threshold amount of motion necessary for an alarm condition. In this manner, one can turn the AMDA member 50 on and adjust the adjuster element to the desired amount for an alarm condition, being that condition wherein the threshold amount of motion has been exceeded and an alarm is sounded. Thus, for example, the AMDA member 50 can be set to have a low sensitivity, i.e., a higher than normal threshold amount of motion is required to constitute an alarm condition. This is very beneficial when the assembly 9 is placed near a railroad track, as opposed to on an exhibition floor near an exhibitor's booth.

Also, the on/off operation and the alarm signal of the AMDA member need not be limited to a physical, manually-operated switch or an audio siren. Either or both the on/off function and the alarm function can be accomplished by using other techniques, such as selected ultrasonic, RF or IF waves or frequencies generated by a controlling unit or the AMDA member.

A first fastening element 61 is fixedly secured to the AMDA device 50 for mounting it to the interior of the container 10. And, a second fastening element 60 is fixedly secured to the interior of the container 10 so that the AMDA member 50 can be removably supported in one of a plurality of locations in the container 10.

Figure 2:
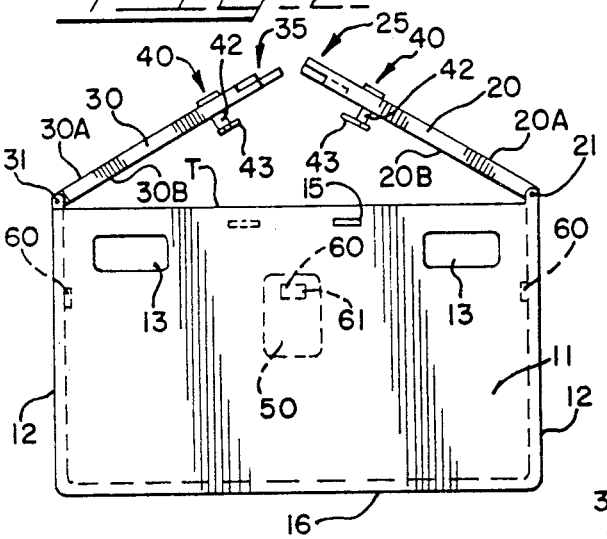
FIG. 2 is a side elevation view of a security container with its cover partially open that is made in accordance with the teachings of the present invention.
Figure 4:
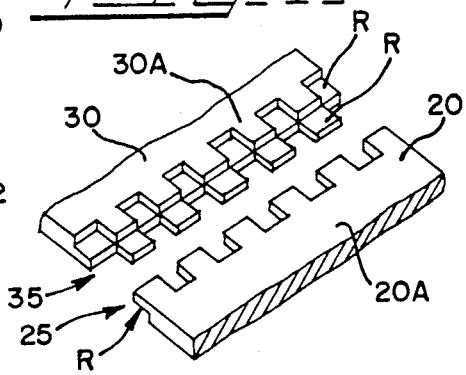

As shown in FIGS. 2 and 3, the second fastening element 60 is preferably a plurality of such elements, one located on the interior of each wall 11, 12, and on the portion of the wall 11, 12 closer to the wall top T than the container bottom 16. In this manner, the user of the improved container 9 has a number of choices in which to place and position the AMDA member 50. Thus, if something is in the container and packed up against an end wall 12, the AMDA 50 can be situated on the other end wall 12, or on one of the side walls 11.

Any quick-release fasteners can be employed in this invention. An important point here is the use of quick-release fasteners that require no accessory tools to be engaged or disengaged. A further important point is that the second fastening element 60 is oftentimes exposed without anything covering it or protecting it, and, therefore, it should not mar surfaces that are rubbed up against it. Similarly, the second fastening element 60 must not project too far outwardly from the interior of the walls. In this manner, this fastener 60 will not hurt an individual or item rubbed up against it.

Hook and loop type fasteners are preferred. It has been found that the product VELCRO®, which comprises hook and loop tape-type fasteners made of nylon are sufficient fastening elements. The first fastening element 61 that is fixedly secured to the AMDA member 50 is a strip of material having a plurality of minute, stiff hook-like projections thereon. The second fastening element 60 that is fixedly secured to the interior of the container on the upper portions of the walls 11, 12 is a strip of hirsute material or a plurality of tiny, soft loops. The second fastening element 60 of tiny, soft loops cooperates or mates with the first fastening element 61 of minute, stiff hook-like projections.

While in the figures the second fastening elements 60 has been shown to be a plurality of generally short strips, it is recognized that one large generally horizontal strip of fastening material can be positioned on the upper portions of the interior walls. Also, many long, distinct strips of generally horizontal fastening material can be used. However, while the longer strips or the one single strip provide the user with many more options regarding the placement of the AMDA member 50 within the container 10, the probability of damaging the strip or strips increases since items that are loaded and unloaded into or out of the container 10 commonly scrape up against the walls' interior surfaces.

By using VELCRO® tape or similar fastening elements, the items scraping up against the fastening elements 60 should not get scratched or damaged. Also, positioning each of the second fastening elements 60 closer to the top T of the walls 11, 12 than the bottom 16 of the container 10 facilitates a user's access to the AMDA member 50, i.e., turning it on or off, adjusting it or moving it. Further, since loading is oftentimes not done to capacity, this construction of having each of the second fastening elements 60 that releasably holds the AMDA member 50 on the upper portions of the walls 11, 12, reduces the chances of the AMDA member or a second fastening element from interfering with the packing or unpacking of the container 10 and the chances of the items so packed damaging the AMDA member or a fastening element. Finally, the positioning and mounting of the AMDA member 50 in the upper portion of the container 10 significantly aids in permitting an audio alarm siren to emanate from the interior of the container 10 and reduces the chances of items in the container from covering the member and possibly muffling its siren.

Specifically, in order for the AMDA member 50 to warn the user or to scare a thief, the member's siren must be detectable to an outsider. It has been found that a successful construction to permit such detection is to provide a plurality of apertures 13, 14 in the walls 11, 12 of the container 10 that are positioned closer to the top T of the wall 11, 12 than to the bottom 16 of the container 10. As shown in FIGS. 1 and 2, each end wall 12 has an end aperture 14 in its upper portion and each side wall 11 has two side apertures 13 in its upper portion. Having such apertures 13, 14 permits the audio alarm siren generated by the AMDA member 50 to emanate from the container 10 to scare an intruder and to notify individuals that the container 10 has been violated, i.e., carried away or broken into. Thus, the individual in charge of the security assembly 9 can unlock the container 10 and turn off the alarm siren or can notify the authorities.

Significantly, each of the apertures 13, 14 of the present invention has a cross-sectional area that is relatively small so as to prevent an entire adult hand from passing therethrough. If an adult hand could penetrate the container 10 through an aperture 13, 14, the adult would be able to reach into the assembly 9, while it is locked, and turn off the AMDA member 50 and steal the container's contents. The apertures 13, 14 of the present invention can, however, be constructed large enough so as to be used as hand slots for moving the container 10. Thus, while an individual may not be able to get her hand entirely through the apertures 13, 14, she could curl her hand into the apertures 13, 14 leaving her thumbs outside the container 10 and carry the container alone or with others.

While the specific embodiments have been illustrated and described, numerous modifications come to mind without significantly departing from the spirit of the invention and the scope of protection is only limited by the scope of the accompanying claims.

I claim:

1. A security container comprising:

a storage container having walls and a bottom, each said wall having a top, and a cover comprising at least one lid hingedly connected to one of said walls, said cover being movable between an open and a closed position;

means for locking said cover in said closed position to prevent improper entry into said storage container;

means within said storage container for detecting a greater-than-threshold amount of motion of said container;

means within said storage container for emitting an alarm signal when a greater-than-threshold amount of motion has been detected;

cooperating quick-release fasteners for mounting said detecting means and alarm signal means in any one of a plurality of locations within said storage container, one said fastener secured to said detection means and said alarm means and a plurality of fasteners secured to said storage container for selectively cooperating with said fastener secured to said detection means and said alarm signal means; and, means for permitting said alarm signal to emanate from said storage container.

2. The security container defined in claim 1 wherein said motion-detection means and said alarm signal means is an audio motion-detecting alarm member having a motion-sensor coupled with a speaker element therein for emitting an alarm siren when said greater-than-threshold amount of motion has been detected.

3. The security container defined in claim 2 wherein said cooperating quick-release fasteners are at least one strip of fastening material having a plurality of hook-like projections thereon fixedly secured to said audio motion-detecting alarm member and a plurality of strips of fastening material having hirsute material thereon fixedly secured to the interior of said walls at a location closer to said walls' top than said storage container bottom for receiving and cooperating with said hook-like material, said fastening materials being adherent to one another when in contact with each other.

4. The security container defined in claim 3 wherein said locking means is at least one lock assembly attached to said cover with a rotating cam thereon for cooperating with at least one said wall for interconnecting said wall to said cover.

5. The container defined in claim 4 wherein said cover is two interconnecting lids, each movable between an open and a closed position, each said lid being hinged at one end to said top of one of an opposed pair of said walls, said lids remaining in a closed position if said lids are interlocked and one said lid is locked to one said wall.

6. The security container of claim 5 further including means for identifying that said container is locked.

7. The security container of claim 6 wherein the identifying means is said cam projecting through a cooperating slot in one said wall.

8. A security container comprising:

a storage container having walls and a bottom, each said wall having a top, and a cover comprising at least one lid hingedly connected to one of said walls, said cover being movable between and open and a closed position;

means for locking said cover in said closed position to prevent improper entry into said storage container;

an audio motion-detecting alarm member within said storage container having a motion-sensor coupled with a speaker element for emitting an alarm siren when a greater-than-threshold amount of motion of said container has been detected;

means within said storage container for emitting an alarm signal when a greater-than-threshold amount of motion has been detected;

means for mounting said detecting means and alarm signal means in any one of a plurality of locations within said storage container; and, a wall with an aperture therein for permitting said alarm siren to emanate from said storage container, said aperture being located closer to said wall top than said storage container bottom and having a relatively small cross-sectional area to prevent an entire adult hand from passing therethrough.

9. A security storage assembly comprising:

a container for storing contents therein having an interior and an exterior, side walls, end walls, and a bottom, at least one said wall having an aperture therein, each said wall having a top, a cover comprising at least one lid movable between an opened and closed position hingedly connected to the top of one of said walls, said aperture in said wall being positioned closer to said wall top than said container bottom and said aperture having a relatively small cross-sectional area so as to permit said emitted alarm siren to emanate from said container and to prevent an entire adult hand from passing therethrough;

a lock assembly for coupling said cover to said container to keep said cover closed and for preventing improper entry into said container;

an audio motion-detecting alarm member removably mounted within said container having a sensing mechanism therein for detecting a greater-than-threshold amount of motion and having a speaker element therein for emitting an alarm siren when said greater-than-threshold amount of motion has been detected;

a first fastening element fixedly secured to sid audio motion-detecting alarm member; and, a second fastening element fixedly secured to said interior of said container for cooperating with said first fastening element to removably support said audio motion-detecting alarm member to said interior of said container in one of a plurality of locations on said walls.

10. The security storage assembly defined in claim 9 wherein said first fastening element is a strip of fastening material having a plurality of hook-like projections thereon and said second fastening element is a mating strip of fastening material having a plurality of loops thereon.

11. The security storage assembly defined in claim 10 wherein said second fastening element is a plurality of strips of fastening material having a plurality of loops thereon, each said strip being fixedly secured to said interior of said container at a location closer to said wall top than said container bottom.

12. The security storage assembly defined in claim 11 wherein there are a plurality of apertures in the upper portions of said walls, each said aperture being sized so as to have a relatively small cross-sectional area to prevent an entire adult hand from passing therethrough.

13. The security storage assembly defined claim 12 wherein said cover is two opposed interconnecting lids, each said lid being hinged at one end to said top of one said end wall and being movable between an open and closed position, said lids remaining in a closed position if said lids are interlocked at each said other end and one said lid is locked.

14. The security storage assembly defined in claim 13 wherein said lock assembly is connected to one said interconnecting lid and includes a rotating cam for cooperating with one said side wall for interconnecting said cover to said side wall.

15. In combination with a container having walls, a closed bottom and a cover hingedly connected to the top of a wall, at least one lock assembly for preventing improper entry into said container, said lock assembly interconnecting said cover to a wall;

a motion-detecting alarm member removably mounted within said container having a sensing mechanism for detecting a greater-than-threshold amount of motion and having a coupled alarm element therein for emitting an alarm signal when said greater-than-threshold amount of motion has been detected;

a quick-release fastening element fixedly secured to said motion-detecting alarm member and a plurality of spaced cooperating quick-release fastening elements for cooperating with said fastening element secured to said motion-detecting alarm member, each one cooperating quick-release fastening elements being fixedly secured to the interior of a said wall; and, means for permitting said alarm to emanate from said storage container.

16. The combination in claim 15 wherein said alarm signal is an audio alarm siren and said means for permitting said alarm to emanate from said storage container is at least one said wall having an aperture therein, said aperture being sized so as to not only permit said alarm siren to emanate from said container but also to prevent an entire adult hand from passing therethrough.

* * * * *